US006897765B2

(12) United States Patent
Kaje

(10) Patent No.: US 6,897,765 B2
(45) Date of Patent: May 24, 2005

(54) REMOTE DOORBELL RINGER

(75) Inventor: Roberto Kaje, 5804 Queens Chapel Rd., Apt #3, Hyattsville, MD (US) 20782

(73) Assignee: Roberto Kaje, Bowie, MD (US)

( * ) Notice: Subject to any disclaimer, the term of this patent is extended or adjusted under 35 U.S.C. 154(b) by 0 days.

(21) Appl. No.: 10/033,214

(22) Filed: Dec. 27, 2001

(65) Prior Publication Data

US 2003/0122665 A1 Jul. 3, 2003

(51) Int. Cl.[7] ..... G08B 23/00

(52) U.S. Cl. ..... 340/321; 340/330; 340/332; 340/326

(58) Field of Search ..... 340/537, 5.2, 5.61, 340/5.64, 326, 328, 330, 332, 321, 331

(56) References Cited

U.S. PATENT DOCUMENTS 5,646,596 A * 7/1997 Gumm ..... 340/573.1

* cited by examiner

*Primary Examiner*—Daryl Pope

(57) ABSTRACT

A remote control device when actuated by a user transmits a visually perceptible coded signal to a sensor associated with a doorbell which receives the signal and causes activation of the doorbell as desired. The sensor has multiple settings which control operation of the doorbell such that any, specified, or no remote devices may operate the doorbell depending on the setting that is selected on the sensor.

1 Claim, 1 Drawing Sheet

REMOTE DOORBELL RINGER

2) CROSS-REFERENCE TO THE RELATED APPLICATIONS

| PATENT | DATE | US INVENTOR OR COUNTRY | TITLE |
|---|---|---|---|
| 3,795,896 | Mar. 5, 1974 | Isaacs | Wireless Alarm System |
| 4,236,147 | Nov. 25, 1980 | Calvin | Automatic Doorbell |
| 4,523,193 | Jun. 11, 1985 | Levison et al | Remote-controlled Doorbell Signal Receiver |
| 4,924,214 | May 8, 1990 | Hill | Door Mat alarm |
| 5,612,666 | Mar. 18, 1997 | Xydis | Wireless Audible Indications System |
| 5,748,074 | May 5, 1998 | Chomet | Electronic Door Chime |
| 5,757,305 | May 26, 1998 | Xydis | Transmitter for wireless Audible Indications System |
| U.S. Pat. No 6,208,238,B1 | Mar 27, 2001 | Ohta | Electromagnetic Sound Generating Body |
| 2 605 775 | Apr. 29, 1988 | France | Removable audible Warning device intended to be mounted on a Door |
| DE 195 43 365 A1 | May 22, 1997 | Germany | Ringing Circuit with Automatic Volume Control for Radiotelephone, Doorbell or Alarm |
| EP 0 836 150 A1 | Apr. 15, 1998 | Europe | Remote Activation System |
| 2 796 237 | Jan. 12, 2001 | France | Remote house/flat doorbell unit has front door plate . . . |

3) BACKGROUND OF THE INVENTION

This invention is a "REMOTE DOORBELL RINGER" that can replace or provide additional functionality to a house, an apartment or an office doorbell because of the following.

Since the invention of the doorbell ringer, there have been inventions associated with the remote operation of the "doorbell ringer" but none with my invention functionality, including:

(1) U.S. Pat. No. 3,795,896 of Mar. 5, 1974 "wireless Alarm System" for home and office which includes transmitter and receiver assemblies.

(2) U.S. Pat. No. 4,236,147 of Nov. 25, 1980 "Automatic Doorbell" relates to a method for detecting the approach of a person on the outside of a closed door and producing a pleasing tone on the inside of the door when such an approach is detected, adaptable to function as automatic doorbell.

(3) U.S. Pat. No. 4,523,193 of Jun. 11, 1985 "Remote-Controlled Doorbell Signal Receiver". A transmitter for generating an over-the-air radio signal is coupled across the wired doorbell so that the transmitter will be actuated in response to current flowing through the wired doorbell. A remote receiver coupled to sound producing means receives the over-the-air radio signal and actuates the sound producing means when the existing doorbell is energized.

(4) U.S. Pat. No. 4,924,214 of May 08, 1990 "Door Mat Alarm" is set forth including a flexible mat and encapsulated pressure switches positioned in a matrix throughout the mat whereupon compression of the flexible mat relays pressure to the switches and activated a remotely positioned transmitter to actuate an alarm. A modification of the invention includes a transmitter encapsulated adjacent a forward edge of the mat to relay a signal to a remote receiver portably carried by an individual.

(5) U.S. Pat. No. 5,748,074 of May 5, 1998 "Electronic Door Chime" relates to an Electro-mechanical door chime which is activated by a remote door-mounted switch and radio transmitter.

(6) Patent # DE 19543365 "Ringing circuit with automatic volume control for radiotelephone, doorbell or alarm" is an intelligent call system which has a switching circuit for switching call signal generator between different volume levels in dependence on the range and the ambient noise level, provided by IR sensors and a microphone. Preferably, a harmonic volume regulation is effected in dependence on the distance of the user provided by a number of IR sensors, detecting body heat and the ambient noise detected by the microphone, using a transistor switch.

(7) European Patent EP 0 836 150 A1 of Apr. 15, 1998 "Remote Activation System" to be used e.g. by disabled persons who lack the capacity of using their hands to the normal operation of a keyboard, comprises a laser pointer which the disabled operator may support on his head by means of a headrest and /or a mouse which include light sensitive devices associated to each key or function, whereby the laser beam produced by the laser pointer may be directed to anyone of the light receiving devices which are included in an electronic circuit such as to simulate mechanical pressing of any individual key or the rolling operation of a real computer mouse. The same remote activation system may also be used for operating a telephone, a lamp, a household appliance, a door, a window or a water spigot.

(8) France Patent FR2605775 of Apr. 29, 1998 "Removable audible warning device intended to be mounted on a door", includes a removable U-shaped support capable of being slipped over the edge of the leaf of the door.

France Patent FR2796237 of Jan. 12, 2001 "Remote house/flat door bell unit has front door plate with doorbell ringer/two way speech interchange and roving wireless response unit providing householder interaction/door opening". The doorbell unit has a base station mounted on the wall where the front door is, and relaying door chimes and speech using a radio signal. The house owner has a mobile responder which allows the caller to speak to the house owner, and to activate door opening.

With all inventions above, the following problems still need to be solved. If the neighbors have the same doorbell system, is it possible to activate only one doorbell at a time without causing disturbing activations of other doorbells with the same remote?

By answering the above question, this invention will reduce the use of alternative means such as (for example) using an automobile horn to get the attention of people who are inside a house, eliminating this type of undesirable noise from neighborhoods. And it could be used by everybody, including delivery services. When the invention is used in "private mode" only persons having the "select remote" could activate the doorbell, ensuring the privacy of the owner of the doorbell ringer.

4) BRIEF SUMMARY OF THE INVENTION

When activated by the user pressing a switch, the remote control device sends a low powered laser light to the sensor such that the remote user will see the laser on the sensor before pressing the remote control device switch (again) to confirm and execute the doorbell activation through the invention's sensor apparatus and connection to the doorbell.

5) DETAILED DESCRIPTION OF THE INVENTION

1) The remote (1) will be universal such that one remote control device can operate any compatible doorbell that is modified to detect laser light per this invention. Because it will be widely used, the remote also needs to be selective, which is why the invention employs a laser light (2) as the medium to connect the remote control device (send a signal) to the selected doorbell sensor.
2) The sensor (3) will be mounted on and displayed in the front of the building (e.g., near a house number/address sign, door or window, etc.). When activated by the user pressing a switch, the remote control device sends a low powered laser light to the sensor such that the remote user will see the laser on the sensor before pressing the remote control device switch (again) to confirm and execute the doorbell activation through the invention's sensor apparatus and connection to the doorbell.
3) When the doorbell receives the activation signal (e.g., power switch closure) and other possible information from this sensor (as applicable), it is activated as originally designed, such as if its standard doorbell switch had been pressed.

The doorbell needs to be connected to this sensor apparatus, and either the doorbell or the sensor (or both) could have a switch (es) to select one of 3 (or more) options:

1) Public: When in this position, the sensor and thus the doorbell can be activated by any compatible remote control device, as designed and specified under this invention.
2) Private: The sensor and doorbell are activated only by one or more user-specified remote control device(s) using a private code or signal.
3) Off: The doorbell cannot be activated by the invention's remote doorbell ringer device.

The unique features and benefits of this Universal Remote Activated Doorbell are follows:

1) The remote control device(s) and sensor activation device (s) are universal for all design-compatible doorbells, meaning that a range of specific models or designs for these components is possible.
2) On private mode only the selected remote control device could activate the doorbell. On public mode any compatible remote control device could activate the doorbell.

Figure 1:
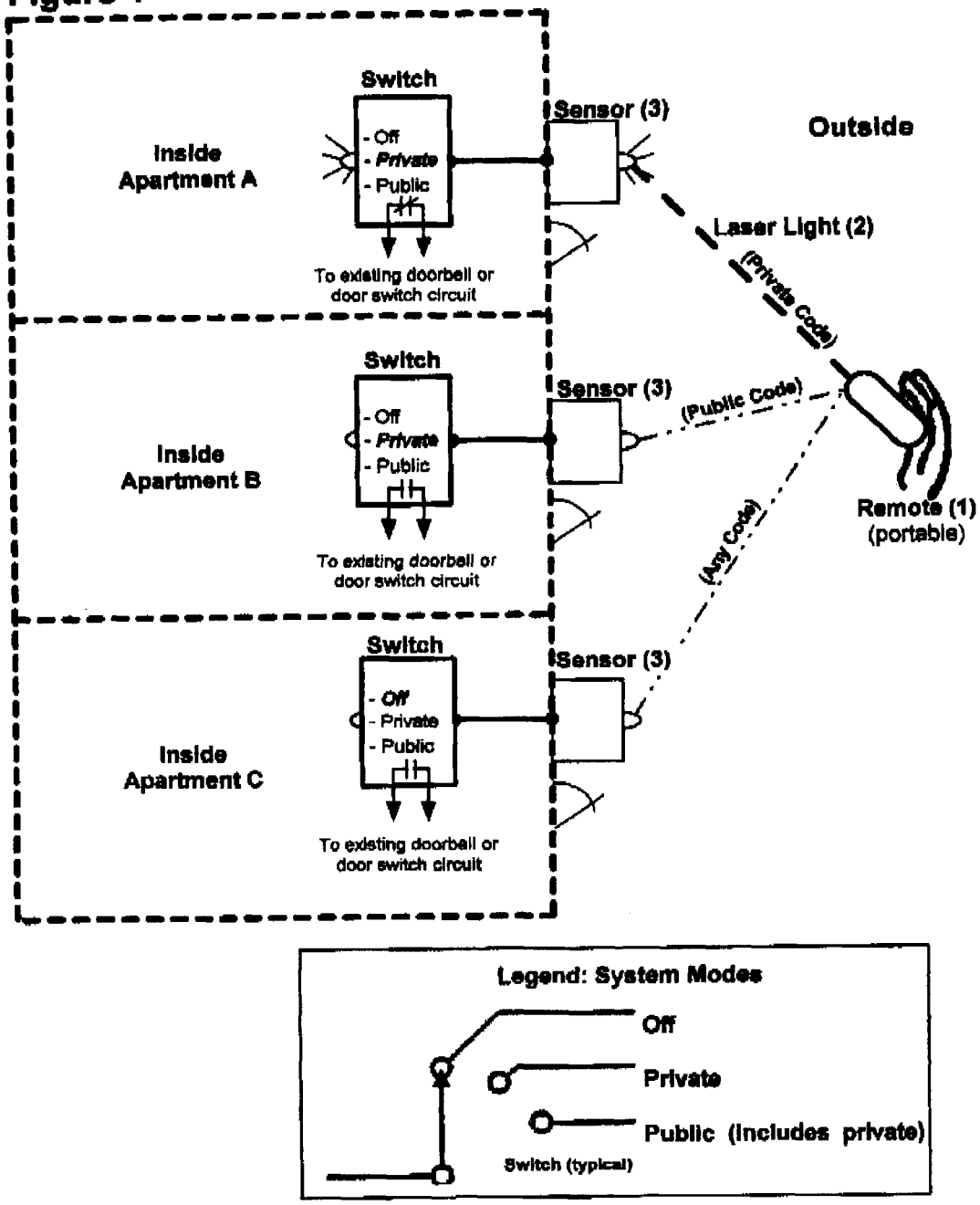
FIG. 1 is a diagram of a preferred embodiment of the system for remotely activating a doorbell.

I claim:

1. A remotely activated doorbell system for a building having a door and a doorbell, said system comprising:

a sensor means connected to said doorbell, which receives a coded laser beam signal, and upon receiving said signal, causes activation of said doorbell;

a switch means, included in said sensor means, for selecting one of a plurality of options for doorbell operation upon receiving codes from said signal; and a remote control device, including switches for causing transmission of said coded laser beam signal, which causes activation of the doorbell when a user directs the signal to said sensor means, said activation depending on the selected doorbell operation option;

wherein said doorbell operation options include a public option in which any remote control device causes activation of the doorbell, a private option wherein only specified remote control devices having a private code may cause activation of the doorbell, and an off option wherein the doorbell cannot be activated by any received signal.

* * * * *